US006929015B2

(12) United States Patent
Nastoll et al.

(10) Patent No.: US 6,929,015 B2
(45) Date of Patent: Aug. 16, 2005

(54) PROCESS FOR THE AT LEAST PARTIAL ELIMINATION OF CARBON DEPOSITS IN A HEAT EXCHANGER

(75) Inventors: Willy Nastoll, Les Roches de Condrieu (FR); Dominique Sabin, Mellecey (FR)

(73) Assignees: Institut Francais du Petrole, Rueil Malmaison Cedex (FR); Packinox, S.A., Chalon sur Saune Cedex (FR)

( * ) Notice: Subject to any disclaimer, the term of this patent is extended or adjusted under 35 U.S.C. 154(b) by 334 days.

(21) Appl. No.: 10/388,228

(22) Filed: Mar. 14, 2003

(65) Prior Publication Data

US 2003/0230324 A1 Dec. 18, 2003

(30) Foreign Application Priority Data

Mar. 15, 2002 (FR) ..... 02 03209

(51) Int. Cl.[7] ..... B08B 9/00

(52) U.S. Cl. ..... 134/22.1; 134/20; 134/21; 134/22.11; 134/22.12; 134/22.15; 134/22.18; 134/26; 134/30; 134/31; 134/34; 134/36; 134/39; 134/42

(58) Field of Search ..... 134/20, 21, 22.1, 134/22.11, 22.12, 22.15, 22.18, 26, 30, 31, 34, 36, 39, 42

(56) References Cited

U.S. PATENT DOCUMENTS

| | | | | |
|---|---|---|---|---|
| 1,470,359 A | | 10/1923 | Greenstreet | |
| 2,577,254 A | * | 12/1951 | Lawson | 134/2 |
| 3,054,700 A | | 9/1962 | Martin | |
| 3,359,200 A | * | 12/1967 | Gitchel et al. | 210/761 |
| 3,532,542 A | * | 10/1970 | Shimizu et al. | 134/20 |
| 4,376,694 A | | 3/1983 | Lohr et al. | |
| 4,420,343 A | | 12/1983 | Sliwka | |
| 4,849,025 A | | 7/1989 | Bain et al. | |
| 6,113,388 A | * | 9/2000 | Martin et al. | 432/128 |
| 2003/0230324 A1 | * | 12/2003 | Nastoll et al. | 134/39 |

FOREIGN PATENT DOCUMENTS

| | | |
|---|---|---|
| FR | 1501836 | 11/1967 |
| FR | 2119481 | 8/1972 |
| FR | 2767529 | 2/1999 |

* cited by examiner

*Primary Examiner*—Sharidan Carrillo
(74) *Attorney, Agent, or Firm*—Millen White Zelano & Branigan, P.C.

(57) ABSTRACT

The invention proposes a process and device for the at least partial elimination of carbon deposits in a heat exchanger in which an oxidation treatment is carried out comprising at least one controlled-oxidation stage at a conventional temperature between 400 and about 500° C. for a period of at least 4 hours, by means of an oxidizing fluid comprising for the greater part an inert gas, and a lesser quantity of oxygen, under conditions such that the temperatures of the fluids feeding or leaving the heat exchanger remain below about 520° C. throughout the oxidation treatment, and in that the hot approach of the exchanger remains below about 120° C. throughout the oxidation treatment. The invention also relates to a hydrotreatment system for the implementation of this process and this device.

16 Claims, 2 Drawing Sheets

PROCESS FOR THE AT LEAST PARTIAL ELIMINATION OF CARBON DEPOSITS IN A HEAT EXCHANGER

The invention relates to a process for the at least partial elimination of carbon deposits inside a heat exchanger. Numerous processes in the oil-refining and petrochemicals industry use indirect exchangers of heat between two fluids, in particular process fluids, in order to recover heat and reduce energy consumption. In particular, feed/effluent exchangers are very frequently used by means of which the feed of a chemical reactor is reheated, at least in part by the effluent from this reactor. Processes using such exchangers are very widespread and there may be mentioned as non-limitative examples: catalytic reforming of hydrocarbons, processes for hydrotreatment of hydrocarbons, comprising in particular hydrodesulphurization, hydrodearomatization, hydrodenitrification, hydrodemetallization processes, processes for hydrodehydrogenation of light paraffins, hydrocracking, processes allowing a so-called atmospheric, or pressurized, or vacuum distillation to be carried out, of a petroleum fraction or of a crude oil etc. Exchangers are also known for the quenching (i.e. rapid-cooling) of effluents of processes operating at high temperatures, for example 800° C. or more, for example steam-cracking or steam-reforming effluents.

Heat exchangers, called "exchangers" hereinafter, operating in systems for implementing these different processes sometimes contain various impurities or various heavy products which can cause fouling, in particular by carbon-containing residues such as coke, polymers of rubbers etc. These deposits do not correspond to well-identified compounds of constant composition and morphology but to products which vary considerably as regards their chemical composition, in particular the H/C ratio, and also morphology, the possible presence of heteroatoms, for example, sulphur, nitrogen or metals, for example the presence of iron in sometimes significant quantities which in certain cases can reach several percent, even 10 or 20% by weight, or even higher.

These carbon deposits (typically comprising at least 50%, and generally more than 70% by weight of carbon, the remainder being constituted by hydrogen and other compounds, in particular of sulphur and metals) are probably formed from several reaction mechanisms, which may explain their variability. Without being bound by a particular or exhaustive explanation, it is conceivable that the formation of gums may possibly result from the presence, permanent or accidental, of traces of oxygen in the feed (capable of forming peroxides that are very reactive with unsaturated compounds (in particular olefins, diolefins or acetylenes)).

The presence of these unsaturated compounds, or heavy compounds such as asphaltenes, or certain cracking products such as polycondensed aromatics or radicals from a partial cracking or an upstream cracking, may possibly favour certain polymerization, or polycondensation, or coking, reactions. In particular metallic impurities (iron, nickel, etc.) can also catalyse certain reactions leading to deposits.

There is thus a need to eliminate carbon deposits formed in exchangers. Processes for the elimination of carbon deposits are already known, and in particular processes for decoking tubular furnaces with coils, for example in steam-cracking furnaces, decoking using an air/steam mixture being typically operated in these furnaces at a temperature of about 800 to 900° C.

Furnace coils are typically composed of strong tubes of great thickness (in general between 5 and 15 mm) and typically have one free end, being suspended by springs or counterweights, or rest on supports which allow for expansion. They are consequently not very sensitive to differential expansions due to differences in temperature. Moreover, their life is limited, for example frequently between 3 and 8 years in steam-cracking furnaces which are subjected to the most frequent decokings.

As regards exchangers, the exchange surfaces typically have smaller thicknesses (usually below 3 mm and even of the order of 1 mm or less for plate exchangers used in refineries). Moreover, their mechanical realization entails many more weld seams (for example in tubular plates for tubular exchangers, or over the entire circumference of plates for plate exchangers).

These exchangers are therefore basically systems which are mechanically more stressed than furnace tubes, much more sensitive to differential expansions or "hot spots", and thus much more fragile from a thermomechanical point of view. Moreover, the expected life for an exchanger reaches and generally exceeds 20 years, which rules out any procedure that may lead to premature aging of the apparatus.

For these reasons, the decoking of exchangers using traditional processes for decoking furnaces (under an air/steam mixture at a high temperature) comes up against an unfavourable preconceived notion of a person skilled in the art and is not practised in the case of conventional exchangers, despite the theoretical advantage resulting from the possibilities of cleaning in situ, because of the significant risks of thermomechanical deterioration that are due in particular to the occurrence of "hot spots" linked to the high exothermicity of combustion reactions.

The standard process used for decoking exchangers (and more generally for the elimination of carbon deposits) consists of carrying out mechanical decoking by reaming the exchange tubes, or by mechanical action of a water jet at a very high pressure of several tens of megapascals (hydraulic decoking). These standard techniques are however more restrictive as regards operating periods and maintenance than the technique of decoking of furnaces by combustion, because of the necessity of cooling the equipment and disassembling it to access the tubes to be decoked. Moreover, these techniques are not applicable to welded-plate exchangers: These exchangers cannot be decoked mechanically or hydraulically because of a space between plates which is most often much smaller than 10 mm, and the existence of corrugations on the plates which impede the passage of a cleaning tool or access of a hydraulic jet.

However, exchangers are known which can be decoked by combustion: French Patent FR 2 490 317 describes exchangers for quenching steam-cracking effluents, which allow decoking to be carried out by combustion. The decoking process described consists essentially of draining the apparatus at a moderate temperature (preferably 550° C. or less), then increasing the temperature for decoking (i.e. as indicated up to about 750 to 600° C. and preferably up to about 700° C.). This procedure is described exclusively for very particular tubular-type exchangers with double tubes which in addition use particular arrangements of mechanical design and a particular thermal device (thermal insulation body placed around a group of double tubes), allowing the fragility of the apparatus to be reduced during decoking.

Finally, processes are known for the elimination of deposits by means of chemical products, for example oxidants such as in particular ozone or oxygenated water. These processes use chemical products which are not generally used in refineries or on petrochemical sites, and which can pose problems as regards the use or management of chemical discharges.

The invention proposes a process allowing the elimination by controlled oxidation at a low temperature of a large part or all of the carbon deposits in exchangers of a certain type of process, by controlled oxidation in situ, with ordinary technical means, and without the risk of mechanical deterioration of the apparatus. The process does not require the modification of the exchangers and is applicable to all types of tubular exchangers and also to welded-plate exchangers. The invention also proposes a process for the at least partial, relatively rapid, elimination of carbon deposits which allows the period of operation to be limited, still without the risk of mechanical deterioration of the apparatus. The invention also proposes a device for the implementation of the process, and a system for the hydrotreatment of hydrocarbons containing a device for the elimination of deposits by controlled oxidation.

In the description of the invention which follows, the following conventions and definitions will be used:

An exchanger of heat between at least two fluids (without excluding a greater number), at least one of which comprises hydrocarbons, will be called a heat exchanger, or simply exchanger. An exchanger according to the invention may operate in counter-current (most often the case), but also in co-current, or crosscurrent or counter-current together, without excluding other configurations. An exchanger according to the invention comprises an oblong body and two ends, at least one of which (and generally both) is the seat of a thermal exchange between two fluids entering or leaving the exchanger, i.e. feeding or leaving the exchanger: these fluids can be two fluids entering, or two fluids leaving or one fluid entering and one fluid leaving the exchanger. The fluid entering or leaving the exchanger with the highest temperature is called the hottest fluid. The end which is the seat of a thermal exchange between the hottest fluid and at least one other fluid (generally only one) is called the hot end of the exchanger. The difference in temperature between the hottest fluid on the one hand and the coldest fluid on the other exchanging heat with the hottest fluid at the hot end of the exchanger is called the hot approach. In general, there are only two fluids exchanging heat at the hot end, and the hot approach is the difference in temperature between these two fluids. The maximum temperature of the hottest fluid during the normal operation of the exchanger is called the service temperature of an exchanger.

By chemical treatment is meant a treatment in a chemical reactor using one or more chemical reactions. The chemical treatments according to the invention comprise hydrotreatments, i.e. treatments under hydrogen of hydrocarbons to carry out in particular, and in non-exclusive manner, one or more of the following reactions: desulphurization, denitrification, hydrogenation of aromatics, demetallization. The chemical treatments according to the invention also comprise selective hydrogenations of acetylenes and/or diolefins, dehydrogenation reactions, for example of butene to butadiene, of propane to propylene, or dehydrogenation of other paraffins (for example ethane, butane, paraffins in particular linear paraffins having about 10 to 14 carbon atoms for the preparation of precursor olefins of linear alkylbenzenes, etc.). The chemical treatments according to the invention also comprise hydrocracking, catalytic reforming, steam reforming, total saturation of olefins, diolefins or acetylenes, and more generally other reactions of the oil or petrochemicals industry.

The invention is very generally applicable to exchangers the service temperature of which is below about 540° C. and preferably below about 520° C. Preferably it is not used in high-temperature services for example for decoking of exchangers for quenching steam-cracking effluents, for reasons which will be explained hereafter.

The conventional temperature of a stage of oxidation of deposits is by definition the maximum temperature of a thermal-exchange wall at the hot end. This temperature, which can be fixed or variable, will according to the invention be calculated by convention at the inlet of the exchange zone, after the zone for the distribution and/or evacuation of the fluids. This calculation can be easily carried out by a person skilled in the art using the general laws of thermal engineering. However, minor differences in the result of the calculation may occur depending on the calculation method used. A person skilled in the art will thus be able, to carry out the invention, to consider the highest value which corresponds to a conservative value for implementing the invention.

By elimination of deposits in situ is meant that the exchanger remains in place during the operation of elimination of the deposits, and is not disassembled and transported to another site.

By hydrotreatment system comprising a device for the elimination of deposits is meant that this system comprises at least the principal technical means of the device installed on the actual site of the system, and able to be easily connected (for example by a hose, pipework sleeve etc.) if fouling of the exchanger occurs.

DESCRIPTION OF THE INVENTION

The invention proposes a process for the at least partial elimination of carbon deposits in a heat exchanger between two fluids including at least one hydrocarbon fluid, this exchanger operating with a maximum service temperature below about 540° C., and preferably below about 520° C., in a system for the implementation of a chemical treatment or fractionation process, in which:

- the exchanger is purged by an inert gas to virtually eliminate the hydrocarbons,
- a pre-heating of the exchanger is carried out, then it is subjected to an oxidation treatment of at least part of the carbon deposits, comprising at least one controlled-oxidation stage at a conventional temperature between about 400 and about 500° C. for a period of at least 4 hours, by means of an oxidizing fluid comprising for the greater part an inert gas comprising, for example, nitrogen or steam or mixtures thereof, and a lesser quantity of oxygen, under conditions such that the temperatures of the fluids feeding or leaving the heat exchanger remain below about 520° C. throughout the oxidation treatment, and in that the hot approach of the exchanger remains below about 120° C. throughout the oxidation treatment. Preferably it is also ensured that the cold approach of the exchanger remains below 120° C., and more particularly 100° C., although this parameter is generally less critical.

Typically, the process according to the invention realizes an in-situ elimination of these deposits, i.e. without moving the exchanger which remains installed on its place of use. The process according to the invention can however also be used on another site.

Preferably, the temperatures of the fluids feeding or leaving the exchanger are kept below about 500° C. throughout the oxidation treatment, and the hot approach of the exchanger remains below about 100° C. throughout the oxidation treatment.

These major thermal limitations may suggest that the rate of oxidation of the carbon deposits is very low, rendering the process inapplicable: Oxidation tests have actually been carried out on steam-cracking furnace coke at 500° C. with oxygen levels of 1 and 2.5%, these tests showing that the elimination by controlled oxidation of this coke is not applicable at a rate that is industrially acceptable under these conditions.

On the other hand, tests for controlled oxidation of deposits formed in hydrotreatment exchangers were carried out, mostly with service temperatures between about 200 and about 450° C. These deposits surprisingly proved to be sensitive to oxidation at a low temperature, including with low oxygen levels such as 1 to 2.5% and even less. These deposits were able to be oxidized and reduced or eliminated without the need to crush them to increase the contact surface with the oxidizing fluid. It was also found that it was possible to control mild oxidation conditions and to avoid any temperature deviations and hot spots during the oxidation procedure.

Without being bound by this explanation, it is thought that the deposits formed at a relatively low temperature and which have not undergone a maturation at high temperatures, above about 520 to 540° C. because of the operating conditions of the exchanger, are inherently different from a coke formed or calcined at a relatively high temperature, and are much more easily oxidizable. Preferred applications according to the invention are the elimination of deposits in exchangers with a service temperature less than or equal to about 450° C.

The major and a typical thermal limitations of the temperatures of the oxidizing fluids feeding or leaving the exchanger, and of the hot approach of the exchanger during the controlled oxidation, allow the thermal parameters on which the thermomechanical stresses of the exchanger depend to be controlled. The low temperatures allow the hot spots at high temperature and the risk of thermal excursion to be virtually avoided. The maintenance of the hot approach at a moderate value also limits the thermomechanical stresses. It was thus possible, by means of thermomechanical modellings, to validate the absence of deterioration of an exchanger, including a plate exchanger, in the range of hot approaches up to 100 or even 120° C.

These thermal limitations can be obtained in different ways according to the process of the invention:

- it is possible to reduce the temperature of at least one of the fluids feeding the exchanger if, during the oxidation treatment, the temperature of one of the fluids feeding or leaving the exchanger reaches or exceeds a limit temperature equal at most to about 490° C.
- it is also possible to reduce the temperature of at least one of the fluids feeding the exchanger if, during the oxidation treatment, the hot approach reaches or exceeds a limit value equal at most to about 90° C.

In these two cases, the reduction of the temperatures in the exchanger leads to a slowing of the oxidation of deposits which tends to reduce and homogenize the temperatures and the approaches.

- The oxygen level in the oxidizing fluid can also be reduced or cancelled if, during the oxidation treatment, the temperature of one of the fluids feeding or leaving the exchanger reaches or exceeds a limit temperature equal at most to about 490° C.
- The oxygen level in the oxidizing fluid can also be reduced or cancelled if, during the oxidation treatment, the hot approach reaches or exceeds a limit value equal at most to about 90° C.

The reduction of the oxygen level in the oxidizing fluid also has the effect of slowing the oxidation of the deposits, which tends to reduce the temperatures and the approaches.

Finally, at the same time, the oxygen level can be reduced or cancelled, and the temperature of at least one of the fluids feeding the exchanger reduced, if one of the limit values of the thermal parameters is reached. By way of example, at the same time, the temperature of at least one of the fluids feeding the exchanger can be reduced by 10° C., and the oxygen level reduced by 10% (or higher values of these two parameters if the expected result is not obtained).

One or [both] of these two parameters can also be adjusted to a desired value by modulating the feed temperature or temperatures of the exchanger and the oxygen level.

Mostly, the oxygen level in the oxidizing fluid during the oxidation treatment is less than or equal to about 2.5 molar %, and preferably less than or equal to about 2.0 molar %. A particularly well-suited range of oxygen levels is the range from 0.4 to 2.0 molar %. The preferred range depends on several factors. One of these is the nature of the inert fluid constituting the main part of the oxidizing fluid: Preferably, the oxygen level in the oxidizing fluid during the oxidation treatment is such that the temperature differential in adiabatic total combustion is less than about 120° C. and very preferably less than 100° C. According to the invention, the temperature differential in adiabatic total combustion of an oxidizing fluid is defined as the temperature increase obtained in adiabatic total combustion (the oxygen being recovered in the form of $CO_2$ and $H_2O$), usually starting from 450° C., at average operating pressure, and with a stochiometric quantity of methane as oxygen reagent.

The process according to the invention can be implemented according to several variants.

According to one of the preferred variants, the oxidation treatment comprises at least two controlled-oxidation stages in which a first oxidizing fluid with an oxygen level c1 between about 0.4 and about 1.5 molar % is circulated in the exchanger during the first of these two stages at a temperature between about 420 and about 490° C. for a period of at least four hours and sufficient to oxidize at least part of the carbon deposits, then a second oxidizing fluid with an oxygen level c2 greater than c1 and between about 1.3 and about 2.0 molar % is circulated in the exchanger during the second of these two stages for a period of at least two hours at a temperature between about 420 and about 490° C. According to this variant, the oxidation treatment is started under very moderate oxidation conditions, which allows the deposits which are very easy to oxidize in very mild conditions to be eliminated. The oxidation is then continued in order to obtain supplementary elimination of deposits with a slightly higher oxygen level. This variant allows the monitoring of the temperatures and of the hot approach of the exchanger at moderate values to be further increased.

According to another of the preferred variants, the oxidation treatment comprises at least one main controlled-oxidation stage and a supplementary controlled-oxidation stage in which a main oxidizing fluid with an oxygen level c3 between 0.8 and 2.0 molar % is circulated in the exchanger during the main stage at a temperature between about 420 and about 480° C. for a period of at least four hours and sufficient to oxidize at least the greater part of the carbon deposits, then a supplementary oxidizing fluid with an oxygen level c4 clearly below c3 and between about 0.2 and about 0.8 molar % is circulated in the exchanger during the supplementary stage for a period of at least two hours at a temperature between about 480 and about 525° C. According to this variant, the greater part of the deposits is eliminated in a main controlled-oxidation stage and a supplementary controlled-oxidation operation is carried out at a relatively higher temperature but with a very low oxygen level. This allows a degree of elimination of deposits to be carried out without the risk of thermal excursion or reaching too high a temperature.

This variant of the process according to the invention can be combined with the variant described previously: The oxidation can be started for example by a first controlled-oxidation stage in which a first oxidizing fluid with an oxygen level cl between about 0.4 and about 1.5 molar % is circulated in the exchanger at a temperature between about 420 and about 490° C. for a period of at least four hours and preferably at least 12 hours, and sufficient to oxidize at least part of the carbon deposits (for example with about 450° C. and 1% oxygen), continuing with a second stage with a second oxidizing fluid with an oxygen level c2 greater than c1 and between about 1.3 and about 2.0 molar % for a period of at least two hours, and preferably at least 8 hours, at a temperature between about 420 and about 490° C. (for example with 450° C. and 2% oxygen), and ending with a third stage with a supplementary oxidizing fluid with an oxygen level c4 clearly below c3 and between about 0.2 and about 0.8 molar %, for a period of at least two hours and preferably at least 8 hours, at a temperature between about 480 and about 525° C. (for example with 500° C. and 0.5% oxygen).

In general, according to the invention the aim is not to necessarily eliminate all the deposits: If, after a prolonged treatment, it is found that residual deposits remain (for example if the increase in loss of pressure due to the coking has been reduced to only 75% to 95% and if the decoking is no longer making perceptible progress), no attempt is made to raise the temperatures (for example to 600° C. and more) and/or raise the oxygen level (for example to 5% or more).

For this reason, the process is more particularly suited to carbon deposits in exchangers with a service temperature which does not exceed about 520° C. to 540° C., which provide more easily oxidizable carbon deposits.

According to one of the preferred provisions of the process of the invention, for the at least partial elimination of carbon deposits in a two-pass feed/effluent exchanger of a chemical reactor, a fluid (identical or different) is circulated, during the controlled-oxidation stage, in each of the two passes of the exchanger. This allows the temperature variations to be reduced further: It was surprisingly found that fouling deposits rarely formed on both sides of the exchange surfaces of the exchanger; in many cases (and mostly in feed/effluent exchangers, in particular for hydrotreatments), the carbon deposits appear exclusively on the feed side, because of generally accidental impurities contained in this feed. The circulation of a fluid on both sides of the exchange surface allows the fluid situated on the non-fouled side to absorb part of the heat of oxidation of the deposits on the fouled side, thus limiting the increase in temperatures.

The circulation in the exchanger can be realized with the same fluid or different fluids in the two passes, in parallel or in series, and can be realized in ascending or descending co-current (for an upright exchanger) or in counter-current. Preferably, at least part of the flow of oxidizing fluid is circulated in the two passes of the exchanger in series and in co-current, during the controlled-oxidation stage.

In one of the preferred variants, at least part of the flow of oxidizing fluid is circulated in the two passes of the exchanger in series, during the controlled-oxidation stage, with an intermediate cooling by thermal mixing or exchange with a colder liquid. This allows a better temperature monitoring to be ensured.

In particular, at least part of the flow of oxidizing fluid can be circulated in the two passes of the exchanger in series, in ascending co-current, during the controlled-oxidation stage.

At least part of the flow of oxidizing fluid can also, and preferably, be circulated in the two passes of the exchanger in series, first on the effluent side, then on the feed side, during the controlled-oxidation stage.

These different fluid-circulation and/or -cooling variants can be used independently or also combined with each other.

Mostly, the oxidizing fluid or fluids are constituted for the greater part by either steam or by nitrogen, with the addition of a lesser quantity of air and possible lesser quantities of carbon monoxide or dioxide. If nitrogen is used as inert gas, mainly in a closed circuit, the oxidizing fluid can also comprise $CO_2$. Thus, the $CO_2$ in the recycling loop can optionally be eliminated by absorption (for example by washing with amines). The gas in the loop can optionally also contain small quantities of carbon monoxide CO.

The operating pressure (maximum pressure in the exchanger) can vary within wide limits during the oxidation process, for example between 0.01 and 10 MPa. The preferred pressure range lies between 0.1 and 2 MPa, and more particularly between 0.1 and 1 MPa. According to one of the variants of implementing the process according to the invention, the exchanger is pre-heated to a temperature of at least about 360° C., and preferably at least about 400° C. in the absence of air and oxygen before starting the oxidation treatment. This allows the oxidation treatment to be started at a significant temperature and the duration of the oxidation treatment to be reduced. This can be very variable depending on the nature and quantity of deposits. It can be between 4 hours and about 400 hours or even more, the preferred duration being between 6 and 200 hours, and very preferably between 8 and 150 hours. Mostly, an oxidation treatment of a duration of at least 24 hours will be used.

When the oxidizing fluid contains steam for the greater part, the exchanger is preferably initially pre-heated under an atmosphere essentially constituted by nitrogen, at a temperature of at least about 160° C. and sufficient to avoid virtually any subsequent condensation of water, before feeding the exchanger with a fluid mainly constituted by steam, for the final pre-heating and/or the oxidation treatment. It is preferable to avoid water condensation which can cause corrosion in the presence of certain impurities for example chlorides. Similarly, after the oxidation treatment, the exchanger is preferably cooled under an atmosphere essentially constituted by steam to a temperature below 400° C. but above about 160° C. and sufficient to avoid virtually any prior condensation of water, then the exchanger is fed with a fluid essentially constituted by nitrogen, to carry out a final cooling of the exchanger to below 100° C. without the risk of condensation of water in the exchanger. Optionally, there is the possibility of not cooling the exchanger to below a temperature at which there is a risk of condensation of water, and resuming operation of the exchanger immediately without major cooling. This is only possible, however, when the temperatures of all the fluids entering and leaving the exchanger are sufficiently high.

The process according to the invention is applicable in particular to exchangers of the type with welded metal plates arranged inside a metal shell. At least part of at least one of the fluids feeding or leaving the exchanger can then preferably be circulated in a space between the plates and the shell during the pre-heating and/or the controlled-oxidation stage. This tends to reduce the differences in temperature between the plates and the shell. Alternatively, this space can be placed under a nitrogen atmosphere, for example at a pressure equal to or slightly greater than the highest pressure of the exchanger.

The exchanger can also be of the tubular type, with tubes, tubular-plate(s) and shell.

The invention also relates to a device for the at least partial elimination of carbon deposits by controlled oxidation in situ in a heat exchanger operating at at most 540° C., preferably at most 520° C., in a system for the treatment of hydrocarbons, for the realization of the process described previously, this device comprising means of feeding an oxidizing fluid comprising essentially an inert gas of the group formed by steam, nitrogen and their mixtures, as well as a quantity of oxygen below 2.5 molar %, and at least one means of keeping the temperatures of the fluids feeding or leaving the exchanger during the oxidation treatment below about 500° C. The device also preferably comprises at least one means of keeping the hot approach of the exchanger, during the oxidation treatment, below about 100° C., for example one of the technical means mentioned previously for the variants of the process: means of reducing the feed temperature of at least one of the fluids, means of reducing the oxygen level, means of measuring the maximum temperature of the set of fluids entering or leaving the exchanger with high-level alarm, means of measuring the hot approach with high-level alarm, etc. Mostly, the device simultaneously comprises at least one means of feeding an oxidizing fluid essentially comprising an inert gas of the group formed by steam, nitrogen and their mixtures, as well as a quantity of oxygen below 2.5 molar % (this means being for example pipework connecting to an air or oxygen system), at least one means of regulating the oxygen level (for example regulation valve and flowmeter) and at least one means of reducing this level (for example automated control system for reducing or closing the air regulation valve, or manual of operating instructions intended for the operator) linked (in the case of an automated procedure) to an indicator or high-temperature alarm of one of the fluids feeding or leaving the exchanger, or an indicator or a (high-level) alarm for the average temperature of the hot side of the exchanger or an indicator or alarm triggered when the value of the hot approach of the exchanger is too high.

Preferably the oxidation procedure can be managed by a programmable controller or a process-control computer.

The invention also proposes a system for the hydrotreatment of distillable hydrocarbons, comprising a feed/effluent heat exchanger operating at at most 540° C., preferably at most 520° C., and also comprising a device for the at least partial elimination of carbon deposits in the exchanger by controlled oxidation in situ in this heat exchanger, this device comprising means of feeding an oxidizing fluid essentially comprising an inert gas of the group formed by steam, nitrogen, and their mixtures, as well as a quantity of oxygen below 2.5 molar %, and at least one means of keeping the temperatures of the fluids feeding or leaving the exchanger during the oxidation treatment below about 500° C.

Preferably, the hydrotreatment system includes a device also comprising at least one means of keeping the hot approach of the exchanger below about 100° C.

The means mentioned previously relating to the hydrotreatment system can comprise for example, in the case too high a hot approach and/or too high a temperature of one of the fluids feeding or leaving the exchanger, a valve allowing the oxygen level in the oxidizing fluid to be reduced, and/or a system for reducing the pre-heating of at least one of the fluids feeding the exchanger.

According to a hydrotreatment system variant according to the invention, the hydrotreatment system comprises a reactor comprising at least one hydrotreatment catalyst, and comprises a device for the at least partial elimination of carbon deposits, this device comprising at least one common means, on the one hand for the at least partial elimination of the carbon deposits in the exchanger, and on the other and at least partly simultaneously, the regeneration of the catalyst by controlled oxidation. This means can be for example an at least partly common circulation loop (for example a ventilator or compressor recycling gas rich in nitrogen, a common means of analysis of the composition of controlled-oxidation effluents).

In general, the system for the elimination of deposits preferably uses means that are common with the hydrotreatment system (in particular for example the process furnace for pre-heating the oxidizing fluid, measurements of flow or temperature with high-temperature alarms, pipework etc.).

Among the hydrotreatment systems concerned, there may be mentioned in particular systems for the hydrotreatment of naphtha (prior to catalytic reforming), for hydrotreatment of gasoline, in particular catalytic cracking, for desulphurizing this gasoline for example to 10 ppm by weight or even less, for hydrotreatment of middle distillates or gasoil cuts (bases for diesel fuel) for a desulphurization to 10 ppm by weight or even less, or domestic fuel oil, or kerosene, and the vacuum distillate hydrotreatments for desulphurization and/or partial dearomatization.

According to a hydrotreatment system variant according to the invention, the hydrotreatment system comprises a device comprising at least one common means, on the one hand for the at least partial elimination of the carbon deposits in the exchanger, and on the other and at least partly simultaneously, the regeneration of the catalyst by controlled oxidation.

It would not depart from the scope of the invention if a small quantity of oxygen or air were introduced from the start of or during preheating of the exchanger and not afterwards, and in particular if the oxidation were started at temperatures appreciably below 360° C., such as about 300° C. or even less. Neither would it depart from the scope of the invention if the temperature or the composition of the oxidizing fluid or fluids during one or more oxidation stages were not constant but variable or changeable, or if different technical variants or technical means known to a person skilled in the art were used in the process, or the device, or the system according to the invention.

BRIEF DESCRIPTION OF DRAWINGS

Reference is now made to the appended figures in which.

DETAILED DESCRIPTION OF DRAWINGS

Figure 1:
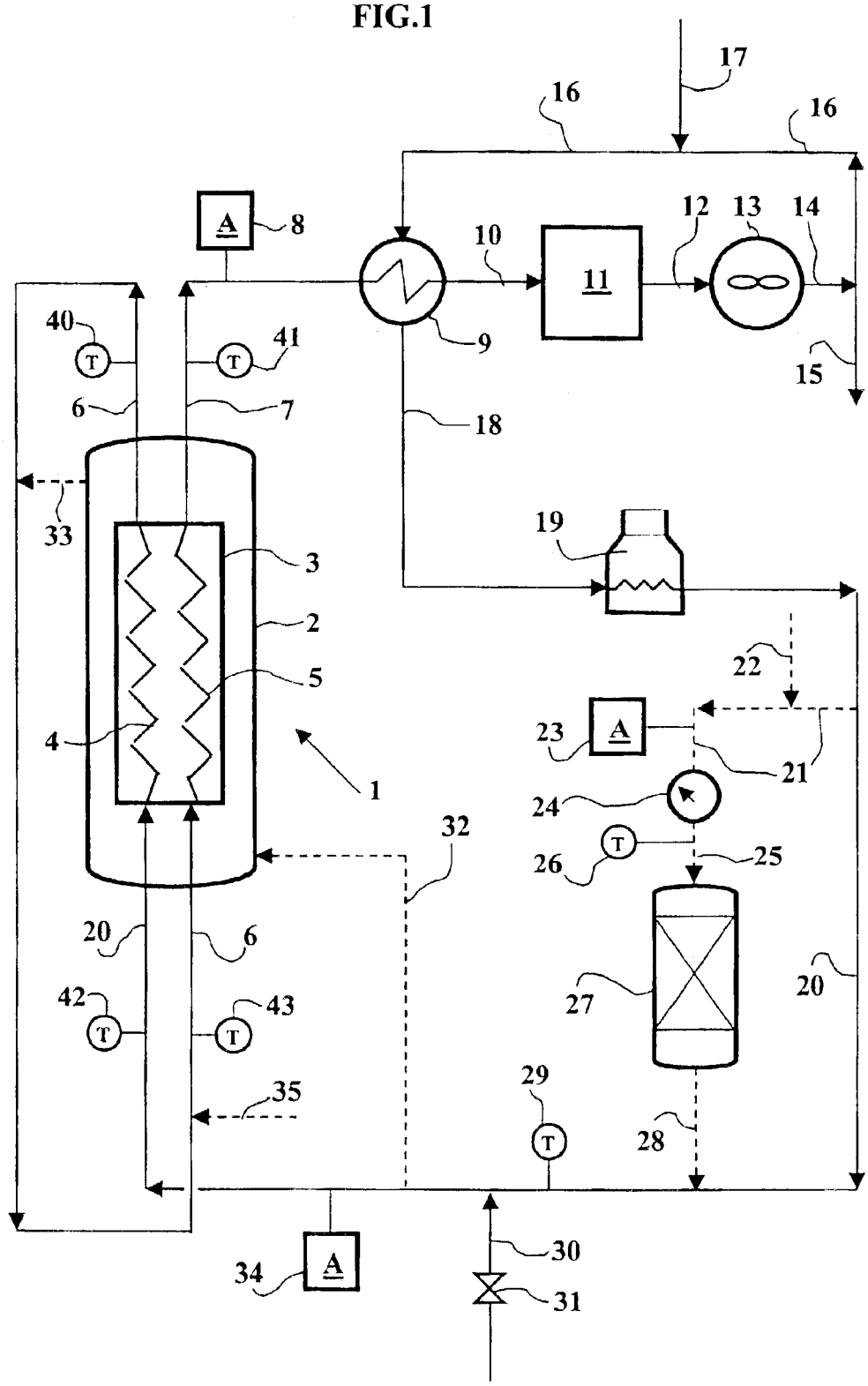
FIGS. 1 and 2 represent two variants of the device for the elimination of deposits according to the invention and for carrying out the process of the invention.

FIG. 1 represents a variant of a device for the at least partial elimination of deposits, with recycling of part of the oxidizing fluid after oxidation of the deposits. In fact the recycling is above all, and in particular at the start of the procedure for the elimination of deposits, an inert recycling, the oxygen being able to be substantially or completely consumed. This system preferably operates with an inert gas comprising mainly nitrogen, with lesser quantities of carbon monoxide or dioxide from the recycling. Exchanger 1 of FIG. 1 is a feed/effluent exchanger for example of a system for the hydrotreatment of gasoil (during its normal service), and is of the type with plates comprising a bundle 3 of welded plates, arranged inside a pressure-resistant shell 2.

The two passes of the exchanger (one, 4, for the circulation of the effluent, the other, 5, for that of the feed during normal service) are represented symbolically by a broken line. Typically, the deposits are situated in the pass 5, on the feed side. The device comprises the furnace 19 for pre-heating the oxidizing fluid which is also the process furnace for the hydrotreatment system. Upon leaving the furnace 19, the oxidizing fluid (which at this stage may possibly be essentially composed of inert gases) circulates in the line 20. Part of this fluid can optionally be diverted by the line 21 to a regeneration circuit (comprising a decoking device) for the catalyst contained in the hydrotreatment reactor 27, this regeneration preferably being effected at least partly simultaneously with the elimination of deposits in the exchanger. The fluid diverted by the line 21 is joined by an air supply arriving via the line 22, to carry out a decoking of the catalyst contained in the reactor 27. The oxygen level is measured by the analyser 23 arranged on the line 21. The fluid then crosses the exchanger 24 to adjust its temperature (by cooling or heating) to the value desired for the regeneration of the catalyst, this catalyst regeneration temperature being able to be different from that used for the elimination of deposits in the exchanger. To monitor this temperature, a temperature detector 26 with a high-temperature alarm is installed on the outlet line 25 for the fluid from the exchanger 24. The (oxidizing) fluid for the decoking of the catalyst then joins the reactor 27, then downstream of the reactor joins the line 20 via the line 28, the downstream end of the by-pass. The gaseous effluent from these two lines circulates in the downstream part of the line 20 which contains a temperature detector 29. The line 20 is joined by an air supply via the line 30 on which there is installed a controlled regulation valve 31 for adjusting the oxygen level in the oxidizing fluid used for the oxidation of the deposits in the exchanger. A relatively small part of this oxidizing fluid can optionally be drawn off by the line 32, cross the free space between the bundle of plates 3 and the shell 2 (to homogenize their temperatures) and be evacuated by the line 33 which joins the line 6 mentioned hereafter. The main oxidizing fluid, after the optional drawing-off via the line 32, circulates in the end-section of the line 20 on which there is arranged an analyser 34 measuring the oxygen level in the oxidizing fluid in order to allow this level to be monitored, and a temperature detector 42 for measuring the temperature of the oxidizing fluid feeding the pass 6 (effluent side) of the exchanger 1. The oxidizing fluid, the oxygen level of which is preferably adjusted to the desired value, then joins the exchanger which it crosses via the pass 4 (hydrotreatment effluent side).

After having circulated in the pass 4 of the exchanger, preferably vertically ascending, the oxidizing fluid leaves the exchanger and circulates in the line 6. From upstream to downstream, this line 6 contains a temperature detector 40 (with high-temperature alarm), is joined by the line 33 mentioned previously, then is joined by a line 35 supplying relatively cold fluid. This feed, optional but preferred, allows the oxidizing fluid to be cooled, which is generally heated while crossing the exchanger a first time in the pass 4, before feeding the pass 5 fouled with the deposits. The relatively cold fluid fed by the line 35 can be for example nitrogen, steam or part of the recycled oxidizing (or virtually inert) fluid, for example recycled starting from the line 18 upstream of the pre-heating furnace 19 (this recycling line not being represented in FIG. 1). Advantageously the monitoring of the process takes account of this arrival of cold fluid for the evaluation of the oxygen level in the oxidizing fluid. Alternatively, it is possible to measure the oxygen level directly downstream of the mixing point with the colder fluid by means of an analyser, not shown.

The thus-cooled oxidizing fluid then circulates in the downstream part of the line 6 which contains a temperature detector 43, then feeds the fouled pass 5 of the exchanger, to carry out controlled oxidation of the carbon deposits, preferably vertically ascending, in co-current with the circulation in the pass 4. After having crossed the pass 5 of the exchanger whilst oxidizing the carbon deposits, the oxidizing fluid (which may possibly have become virtually inert) circulates in the line 7 which contains a temperature detector 41 with high-level alarm and an analyser 8 (or more than one analysis apparatuses) which measures the CO, $CO_2$ and residual oxygen levels in the oxidation effluent of the deposits. This oxidation effluent is then cooled in the heat exchanger 9, then circulates in the line 10 and feeds a gas-treatment system 11. This system preferably contains a separating drum to eliminate the condensed water, and optionally a system for the elimination of $CO_2$, for example by washing with amines. Upon leaving the system 11, the residual gas circulates in the line 12, and is recompressed in the compressor (or ventilator) 13. Upon leaving this compressor 13, part of the residual gas circulating in the line 14 is purged via the line 14, to eliminate an excess of gas resulting in particular from the nitrogen of the air fed by the lines 22 and 30. The supplementary part, comprising mainly nitrogen and lesser quantities of $CO_2$ and CO, is recycled by the line 16. This line 16 is joined by a line 17 supplying nitrogen, used mainly for the starting and cooling phases of the system, in which the fluid feeding the exchanger is below about 160° C. and could condense in the exchanger, which could lead to corrosion. The line 16 then feeds the (optional) exchanger 9, then joins the furnace 19 via the line 18.

This device of FIG. 1 thus preferably operates with a recycling loop containing mainly nitrogen. It enables the parameters of the oxidation operation to be adjusted separately, and in particular the oxygen level and the temperature or temperatures of the supply of oxidizing fluid, on the one hand for the controlled oxidation of the carbon deposits of the exchanger, and on the other (optionally) for the decoking of the catalyst. By way of example, the pass 4 of the exchanger can be fed with an oxidizing fluid with an oxygen level below 2.5% by volume, and sufficiently low for the temperature differential in adiabatic combustion to be less than or equal to 80° C. A feed temperature of 430° C. is chosen at the temperature detector 42, then the (reheated) fluid from the pass 4 is cooled by mixing with recycled gas drawn off on the line 19 (not shown) and fed by the line 35, to take the entry temperature of the fouled pass 5, measured by the temperature detector 43, to a value of 430° C. It is checked that the temperatures measured by the detectors 40, 41, 42, 43 are all below 500° C. and that the hot and cold approaches are below 100° C. If one of these parameters exceeds the desired value, the oxygen level is reduced and also preferably the temperature at the temperature detector 42, limiting the pre-heating in the furnace 19.

A device for the at least partial elimination of deposits can be used differently from that of FIG. 1. By way of non-limitative example, the fluids can circulate in descending co-current and not ascending co-current, and/or firstly feed the pass 5 then in series the pass 4 (the reverse of FIG. 1), or in counter-current with the pass 4 fed first, or else the pass 5 fed first, or in ascending current or in descending current. The decoking of the catalyst can be carried out in parallel or in series with the oxidation of the deposits of the exchanger (or this decoking not carried out with common technical means). The system can also comprise other equipment or technical means not shown such as filters or pressure measurements, various regulations etc. well known in the field of processes or chemical engineering.

Figure 2:
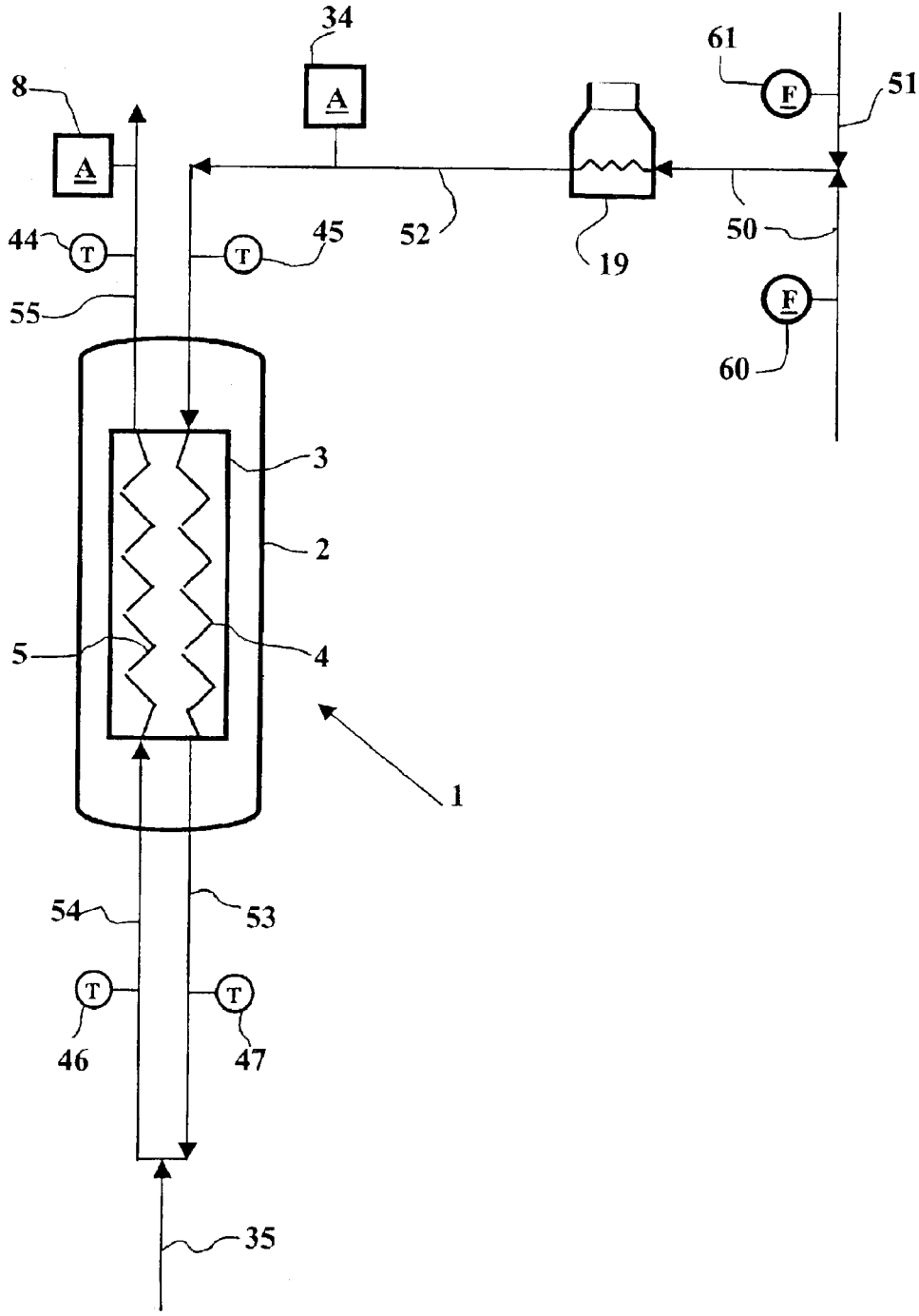

The device in FIG. 2 represents a variant of a device for the at least partial elimination of deposits, without recycling of part of the oxidizing fluid after oxidation of the deposits. The oxidizing fluid mainly comprises steam plus a small quantity of added air. In the device variant in FIG. 2, the oxidizing fluid circulates in series in counter-current in the exchanger, firstly in the pass 4 (in descending current), circulates in the lines 53 then 54, then in the fouled pass 5 (feed side) in ascending current, then leaves again via the line 55 and is evacuated (at the flare, through the stack or in a final-combustion zone, these elements not being shown). The steam is fed via the line 50, at a rate measured by the flowmeter 60. The air is added via the line 51, at a rate measured by the flowmeter 61. Upon departing from the pre-heating furnace 19, the temperature and the oxygen level in the pre-heated fluid, which circulates in the line 52, are measured by the temperature detector 45 and the analyser 34 respectively. The system also comprises other temperature detectors 44, 46 and 47, with high-level alarms, and cooling the fluid leaving at the bottom of the exchanger, via the line 53, with a relatively cold fluid (for example non-pre-heated steam) fed by the line 35, which is optional but preferred. The fluid from the mixture is reintroduced into the bottom of the exchanger to feed the pass 5 (feed side) and allow the oxidation of the deposits. It is possible, by way of non-limitative example, to operate under conditions close to those of FIG. 1, and for example feed the fluids into the exchanger at 430° C., both at the temperature detector 45 and the temperature detector 46. The oxygen level can also be chosen using the same criteria as for the description of the operation of FIG. 1, and the same means of thermal control can be used. The devices of FIGS. 1 and 2 can also operate according to other variants such as those described in the present description.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and, all parts and percentages are by weight, unless otherwise indicated.

EXAMPLES

The following examples explain, in a non-limiting manner, operating conditions which can be used in the process of the invention:

Example 1

According to the Invention: Mock-Up Tests

A mock-up stainless steel welded-plate heat exchanger comprising two welded plates, with herringbone type corrugations, arranged in an external shell heated by electrical resistances, is used. The plates are surrounded by nitrogen and heated at the same time by radiation from the external shell and by convective exchange with the nitrogen.

Firstly, the initial pressure drop of the mock-up under nitrogen is measured in precisely measured flow conditions.

Tests are then conducted for the fouling of the mock-up by carbon deposits under temperature and pressure conditions close to those of a gasoline hydrotreatment process. An olefinic catalytic cracking gasoline with added nitrogen as a diluent of the following grade is circulated between these two plates:

Distillation range: [20–220° C.].

Mass percentage composition paraffins/olefins/naphthenes/aromatics: 33/6/33/28.

The feed is pre-heated to 200° C., its temperature is raised, in the mock-up, from 200 to 250° C., then the pressure drop pattern is noted: This does not change, indicating that no coking or fouling is occurring.

1% atmospheric residue of light Arabian crude oil is then added to the feed, to simulate accidental contamination of this feed, and this feed is placed in contact at ambient temperature with a current composed of nitrogen with a small quantity of added air to simulate a contact of the feed with oxygen in a poorly inertized storage tank. The mock-up is fed and operated with this new feed in the previous conditions.

A steady increase in the pressure drop is then observed, indicating a fouling of the mock-up. When the pressure drop has increased by 60% relative to the initial pressure drop, the circulation of hydrocarbons is stopped by allowing the nitrogen to circulate to purge the mock-up, then the pre-heating of the nitrogen feeding the mock-up is increased by 50° C./hour until it reaches 440° C. The heating of the mock-up itself is adjusted to an exit temperature of 450° C.

Air is then steadily supplied, starting with an oxygen level of 0.5% by volume, up to 1.5% by volume. Care is taken that the exit temperature of the mock-up does not exceed 470° C. (this value can be greater than the adjusted temperature because of the combustion of the deposits), reducing if need be the feed temperature of the mock-up (to below 430° C. or less) and the oxygen level (to below 1% by volume or less).

The quantity of carbon monoxide CO and carbon dioxide $CO_2$ in the outlet effluents is also measured. After a period of 10 hours, it is found that the quantity of $CO+CO_2$ becomes non-measurable, and the controlled oxidation is stopped, then the mock-up is cooled and the pressure drop of the mock-up is measured in the same conditions as those of the non-fouled mock-up. The measured pressure drop is only 2.4% greater than the initial pressure drop, which indicates that the mock-up is fouled very little or possibly not fouled at all taking into account the accuracy of the measurements. It is found after disassembly that the welded plates of the mock-up are not at all deformed, that no coloration of the metal reflecting the occurrence of a hot spot is observed and that the mechanical and metallurgical state of these plates is identical to the initial state.

Example 2

According to the Invention: Mock-Up Tests

Tests are conducted, in the same mock-up as in Example 1, for fouling by carbon deposits with a different feed: a catalytic cracking atmospheric gasoil, a feed generally known under the abbreviation "LCO"

The characteristics of this gasoil are the following:

Distillation Range: [221–350° C.].

Mass percentage composition: Saturates (paraffins+naphthenes)/olefins/aromatics: 16/4/80.

The feed is pre-heated to 310° C., its temperature is raised, in the mock-up, from 310 to 348° C., then the pressure drop pattern is noted: This does not change, indicating that, as in the previous case, no coking or fouling is occurring.

The feed is then modified by the addition of a few heavy contaminants and traces of oxygen, as indicated in example 1. The pressure drop increases, although more slowly than in example 1.

When the exchanger is fouled, a controlled oxidation is carried out in conditions close to those described in example 1, but in three stages:

Stage 1: controlled oxidation at approximately 450° C. and with an oxygen level of 1.0% for 10 hours, keeping the entry/exit temperatures below 470° C.

Stage 2: controlled oxidation at approximately 450° C. and with an oxygen level of 1.9% for 10 hours, keeping the entry/exit temperatures below 470° C.

Stage 3: controlled oxidation at approximately 485° C. and with an oxygen level of 0.5% for 5 hours, keeping the entry/exit temperatures below 500° C.

After cooling, the pressure drop under nitrogen assumes a value only 1.2% greater than that of the clean device, an insignificant value taking into account the accuracy of the measurements. This indicates that the mock-up is very little fouled or not fouled at all. It is also found, after disassembly, that the welded plates of the mock-up are not at all deformed, that no coloration of the metal reflecting the occurrence of a hot spot is observed and that the mechanical and metallurgical state of these plates is identical to the initial state. Plates are then cut out at the periphery (destructive test), to observe the appearance of the internal surfaces. This is normal, without degradation of metal or of the condition of the surface. No trace of carbon deposit is found, indicating that the oxidation of the deposits was more or less complete.

Example 3

According to the Invention, Applicable to an Industrial Heat Exchanger

Case of application: Feed/effluent exchanger of a catalytic cracking gasoline hydrotreatment unit to reduce the sulphur level to below 10 ppm by weight. The exchanger, which is upright, is of the type with a bundle of stainless steel plates formed by explosion, welded together at their periphery, this bundle of plates being arranged inside a pressure-resistant cylindrical shell. Means of eliminating deposits as described in FIG. 1 are used.

The controlled oxidation of the apparatus is preferably carried out without waiting until the fouling is very great. The treatment can for example be carried out if the pressure drop suddenly increases in an unexplained manner, or has rapidly or steadily increased by approximately 50% relative to the normal value, and preferably as soon as the pressure drop has increased by approximately 15 to 40%. It is then preferable to carry out the oxidation treatment without waiting for a supplementary increase, and/or a chemical conversion of the deposits by maturation, which can make cleaning longer or more difficult.

An example of a procedure for cleaning a fouled exchanger is given below:

As soon as the pressure drop of the apparatus has increased by approximately 25% relative to the normal value, stoppage of the system, purging and drainage of the apparatus, which is then swept and placed under nitrogen.

Cooling (possible) to the ambient temperature.

Placing under nitrogen pressure of the space between the bundle of exchange plates.

Heating of the apparatus under steam at the rate of 50° C./hour, up to an average temperature of 430° C. The (possible) initial heating up to 200° C. is carried out under nitrogen in order to avoid any condensation at the moment of tilting under steam.

Stage 1 of controlled oxidation at approximately 450° C. (half-total of the temperatures of the two fluids entering and leaving on the hottest side of the exchanger) below approximately 0.4 MPa, with an oxygen level of 1.0 molar % for 15 hours, keeping the exchanger entry/exit temperatures below 485° C. and the hot approach temperature below 70° C. If one of these two parameters reaches the limit value, the entry temperature and the oxygen level are reduced to re-establish an acceptable value of this parameter.

The molar percentages of CO, $CO_2$ and $O_2$ in the cooled effluent are measured, after condensation and elimination of the water, and the controlled oxidation is continued beyond the expected duration if the effectiveness of oxidation remains substantial, for example if % CO+% $CO_2$/% $O_2$>0.20.

Stage 2 of controlled oxidation at approximately 450° C. under approximately 0.4 MPa, with an oxygen level of 1.9 molar % for 15 hours, keeping the exchanger entry/exit temperatures below 485° C. and the hot approach temperature below 70° C. If one of these two parameters reaches the limit value, the entry temperature and the oxygen level are reduced to re-establish an acceptable value of this parameter.

The molar percentages of CO, $CO_2$ and $O_2$ in the cooled effluent are measured, after condensation and elimination of the water, and the controlled oxidation is continued beyond the expected duration if the effectiveness of the oxidation remains substantial, for example if % CO+% $CO_2$/% $O_2$>0.20.

Stage 3 of controlled oxidation at approximately 480° C. under approximately 0.4 MPa, with an oxygen level of 0.5% for 10 hours, keeping the exchanger entry/exit temperatures below 500° C. and the hot approach temperature below 40° C. If one of these two parameters reaches the limit value, the entry temperature and the oxygen level are reduced to re-establish an acceptable value of this parameter.

The molar percentages of CO, $CO_2$ and $O_2$ in the cooled effluent are measured, after condensation and elimination of the water, and the controlled oxidation is continued beyond the expected duration if the effectiveness of oxidation remains substantial for example if % CO+% $CO_2/O_2$>0.10.

Stoppage of the oxidation and cooling of the apparatus at a rate of approximately 50° C./hour. The (possible) final cooling, to below 200° C., is carried out under nitrogen, after stopping the steam feed to avoid any condensation of water.

The pressure drop under nitrogen is measured and the effectiveness of the elimination of the deposits verified. The operation could be repeated if the elimination of the deposits was deemed insufficient.

Restart of the system according to the conventional procedure.

The process according to the invention makes it possible to carry out an in-situ elimination of carbon deposits in exchangers operating at moderate or average temperatures, in particular in desulphurization and hydrotreatment systems and in an effective, rapid and reliable manner, contrary to the processes known from the prior art. The combination of different usable technical methods (temperature control, limit temperature, oxygen level, measurement of CO, $CO_2$ and $O_2$ levels, steam or nitrogen circulation) are techniques which are very well controlled in refineries or on petrochemicals sites, which makes the process easy to implement. The invention also opens up new prospects for the use of plate exchangers with a process for eliminating deposits which is more effective and/or easier to implement than the processes of the prior art.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The entire disclosure of all applications, patents and publications, cited herein and of corresponding French application No. 02/03.209, filed Mar. 15, 2002 is incorporated by reference herein.

What is claimed is:

1. A process for the at least partial elimination of carbon deposits in a heat exchanger between two fluids including at least one hydrocarbon fluid, this exchanger operating with a maximum service temperature below about 540° C., in a system for the implementation of a chemical treatment or fractionation process, in which:

the exchanger is purged by an inert gas to substantially eliminate the hydrocarbons, a pre-heating of the exchanger is carried out, then it is subjected to an oxidation treatment of at least part of the carbon deposits, comprising at least one controlled-oxidation stage at a temperature between about 400 and about 500° C. for a period of at least 4 hours, by means of an oxidizing fluid comprising on a molar basis, a major quantity of an inert gas comprising nitrogen, or steam or mixtures thereof, and a minor quantity of oxygen, under conditions such that the temperatures of the fluids feeding or leaving the heat exchanger remain below about 520° C. throughout the oxidation treatment, and in that the hot approach of the exchanger remains below about 120° C. throughout the oxidation treatment.

2. A process according to claim 1, in which the temperatures of the fluids feeding or leaving the exchanger are kept below about 500° C. throughout the oxidation treatment, and the hot approach of the exchanger remains below about 100° C. throughout the oxidation treatment.

3. A process according to claim 1, in which the oxygen in said oxidizing fluid is reduced when, during the oxidation treatment, the temperature of one of the fluids feeding or leaving the exchanger reaches or exceeds a limit temperature equal at most to about 490° C.

4. A process according to claim 1, in which the oxygen in the oxidizing fluid during the oxidation treatment is less than or equal to about 2.5 molar %.

5. A process according to claim 1, in which the oxygen in the oxidizing fluid during the oxidation treatment is such that the temperature differential in total adiabatic combustion is below about 100° C.

6. A process according to claim 1, in which the oxidation treatment is carried out in situ.

7. A process according to claim 1, comprising at least two controlled-oxidation stages in which a first oxidizing fluid with an oxygen level c1 between about 0.4 and about 1.5 molar % is circulated in the exchanger during the first of these two stages at a temperature between about 420 and about 490° C. for a period of at least four hours and sufficient to oxidize at least part of the carbon deposits, then a second oxidizing fluid with an oxygen level c2 greater than c1 and between about 1.3 and about 2.0 molar % is circulated in the exchanger during the second of these two stages for a period of at least two hours at a temperature between about 420 and about 490° C.

8. A process according to claim 1, wherein the oxidizing fluid comprising an oxygen level c3 between 0.8 and 2.0 molar % is circulated in the exchanger during the controlled-oxidation stage at a temperature between about 420 and about 480° C. for a period of at least four hours and sufficient to oxidize at least part of the carbon deposits, and further comprising a supplementary controlled-oxidation stage by means of a supplementary oxidizing fluid with an oxygen level c4 below c3 and between about 0.2 and about 0.8 molar % is circulated in the exchanger during the supplementary stage for a period of at least two hours at a temperature between about 480 and about 525° C.

9. A process according to claim 1, for the at least partial elimination of carbon deposits in the exchanger, wherein the exchanger is a two-pass feed/effluent exchanger of a chemical reactor, in which the oxidizing fluid is circulated, during the controlled-oxidation stage, in each of the two passes of the exchanger.

10. A process according to claim 1, in which the exchanger comprises welded metal plates arranged inside a metallic shell.

11. A process according to claim 1, in which the exchanger comprises tubes, tubular-plate(s) and a shell.

12. A process according to claim 1, further comprising, prior to purging, conducting a hydrotreatment reaction of a fluid heated by a heat exchanger thereby resulting in carbon deposits in said heat exchanger.

13. A process according to claim 9, in which at least part of the flow of oxidizing fluid is circulated in the two passes of the exchanger in series and in co-current, during the controlled-oxidation stage.

14. A process according to claim 13, in which at least part of the flow oxidizing fluid is circulated in the two passes of the exchanger in series, in ascending co-current, during the controlled-oxidation stage.

15. A process according to claim 13, in which at least part of the flow of oxidizing fluid is circulated in series in the two passes of the exchanger, during the controlled-oxidation stage, first on an effluent side, then on a feed side.

16. A process for the at least partial elimination of a carbon deposit in a heat exchanger between two fluids including at least one hydrocarbon fluid, this exchanger operating with a maximum service temperature below about 540° C., comprising oxidizing at least part of the carbon deposit between about 400 and about 500° C. for a period of at least 4 hours, by an oxidizing fluid comprising on a molar basis, a major quantity of an inert gas comprising nitrogen, or steam or mixtures thereof, and a minor quantity of oxygen, under conditions such that the temperatures of the fluids feeding or leaving the heat exchanger remain below about 520° C. throughout the oxidation treatment, and in that the hot approach of the exchanger remains below about 120° C. throughout the oxidation treatment.

* * * * *